US007517241B2

(12) United States Patent
Gundlach et al.

(10) Patent No.: US 7,517,241 B2
(45) Date of Patent: Apr. 14, 2009

(54) APPARATUS FOR RELEASING LATCHING CONNECTORS

(75) Inventors: John G. Gundlach, Cary, NC (US); Joel E. Walker, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 10 days.

(21) Appl. No.: 11/565,101

(22) Filed: Nov. 30, 2006

(65) Prior Publication Data

US 2008/0132101 A1 Jun. 5, 2008

(51) Int. Cl.
*H01R 13/627* (2006.01)

(52) U.S. Cl. ..... 439/352; 439/354; 439/344

(58) Field of Classification Search ..... 439/352, 439/354, 357, 344, 676, 372
See application file for complete search history.

(56) References Cited

U.S. PATENT DOCUMENTS

| | | | | |
|---|---|---|---|---|
| 5,308,260 | A | 5/1994 | Johnston et al. | |
| 5,558,533 | A | 9/1996 | Hashizawa et al. | |
| 6,123,564 | A | 9/2000 | Belmore, III | |
| 6,174,190 | B1 | 1/2001 | Tharp et al. | |
| 6,238,251 | B1 * | 5/2001 | Curtis et al. | 439/680 |
| 6,254,418 | B1 * | 7/2001 | Tharp et al. | 439/352 |
| 6,332,798 | B1 | 12/2001 | Farooq | |
| 6,439,918 | B1 | 8/2002 | Togami et al. | |
| 6,447,170 | B1 | 9/2002 | Takahashi et al. | |
| 6,585,537 | B1 | 7/2003 | Lee | |
| 6,702,475 | B1 * | 3/2004 | Giobbio et al. | 385/53 |
| 6,746,264 | B1 | 6/2004 | Branch et al. | |
| 6,824,416 | B2 | 11/2004 | Di Mascio | |
| 6,866,532 | B1 * | 3/2005 | Huang | 439/344 |
| 6,929,403 | B1 * | 8/2005 | Arciniegas et al. | 385/55 |
| 2004/0166716 | A1 | 8/2004 | Oreglio et al. | |
| 2005/0075001 | A1 * | 4/2005 | Shearman et al. | 439/352 |

* cited by examiner

*Primary Examiner*—Hien Vu
(74) *Attorney, Agent, or Firm*—Cynthia G. Seal; Schubert Osterrieder & Nickelson PLLC

(57) ABSTRACT

Systems and arrangements to release a telecommunications cable connector plug from a telecommunications cable connector jack of a telecommunications device are disclosed. Embodiments may include an apparatus to release the plug from the jack. The apparatus may include a pivot and a main body attached to the pivot to rotate about a longitudinal axis of the pivot. The main body may include an arm and a touch point. When the main body is suitably positioned by the attaching of the apparatus to the telecommunications device, a force applied at the touch point may produce a rotation of the arm. The rotation may cause the leading surface of the arm to compress a release lever of the telecommunications cable connector plug and to disengage the telecommunications cable connector plug from the telecommunications cable connector jack. In many embodiments, the pivot may consist of a wire passing through a hole in the main body.

5 Claims, 7 Drawing Sheets

APPARATUS FOR RELEASING LATCHING CONNECTORS

FIELD

The present invention generally relates to the field of devices for removing cable connectors. More particularly, the present invention relates to a system, method, and apparatus for removing a telecommunications cable connector plug from a telecommunications cable connector jack of a telecommunications device.

BACKGROUND

Many types of telecommunications cable connector plugs contain release levers. These types may include modular plugs such as foil twisted pair cable plugs, RJ-plugs such as RJ-45 plugs, and plugs for optical cables. Inserting a plug into a jack may cause the release lever to snap into a locking position against a portion of the jack. In the locking position, electrical contacts from the plug and the jack may engage, establishing an electrical connection between a cable terminating at the plug and a cable terminating at the jack. The plug may be released from the locked position by compressing the release lever. Manual release of a plug requires access to the plug to compress the release lever.

Crowded conditions at telecommunications devices in which the jacks are installed may render access to the release levers for manual removal of telecommunications cable connector plugs difficult. Servers in a complex of servers and, in particular, 1U servers in server racks, may be spaced very closely together. 1U servers are very thin, with a vertical dimension of less than 44.45 mm (less than 2 inches). 7 of them are often placed in a 7U server rack. 1U server applications almost always require latching RJ-45 connectors to be accessible at the rear of the system. The rear of the server rack may be very crowded. To meet thermal challenges, a perforated horizontal wall may be placed above the connectors at the rear of the system to provide for more exit airflow. Additionally, labeling for these connectors may be provided. Most of the time, labeling is added to a shelf under the connectors. As a result, a user may have difficulty in accessing the release lever to compress it or in seeing the release lever in the clutter around an installation of telecommunications devices. To gain access to a release latch on a telecommunications cable connector plug, it may be necessary to first move other equipment, a burdensome operation. Further, the moving may result in interruptions in service.

One alternative is the use of a tool such as a flat blade screw driver. This alternative may be awkward, because there is often not space to get close enough to use the blade and the blade of the screw driver may not be very effective. Custom tools may prove expensive or may be misplaced. Another device contains a spring loaded part that, when depressed, traverses horizontally. A ramp on the part engages the release lever to unlatch the connector. With the method, visibility of the touch point is limited. It may be difficult to spot the spring-loaded part. Secondly, access to the touch point is limited by the space available above or below the connectors. In addition, this method has a potential for jamming the RJ-45 release lever, since the part traverses normal to the tip of the release lever on the RJ-45 connector.

SUMMARY OF THE INVENTION

The problems identified above are in large part addressed by a system, method, and apparatus to release a telecommunications cable connector plug from a telecommunications cable connector jack of a telecommunications device. Embodiments may include an apparatus to release a telecommunications cable connector plug from a telecommunications cable connector jack of a telecommunications device. The apparatus may include a pivot and a main body attached to the pivot to rotate about a longitudinal axis of the pivot. The main body may include an arm and a touch point. When the main body is suitably positioned by the attaching of the apparatus to the telecommunications device, a force applied at the touch point, may produce a rotation of the arm. The rotation may cause the leading surface of the arm to compress a release lever of the telecommunications cable connector plug and to disengage the telecommunications cable connector plug from the telecommunications cable connector jack.

Embodiments may include a system to release a telecommunications cable connector plug from a telecommunications cable connector jack of a telecommunications device. The system may include a telecommunications device and a cable remover attached to the telecommunications device. The cable remover may include a pivot and a main body attached to the pivot to rotate about a longitudinal axis of the pivot. The main body may include an arm and a touch point. A force applied at the touch point may produce a rotation of the arm. The rotation may cause the leading surface of the arm to compress a release lever of the telecommunications cable connector plug and to disengage the telecommunications cable connector plug from the telecommunications cable connector jack.

Another embodiment provides a method to release a telecommunications cable connector plug from a telecommunications cable connector jack of a telecommunications device. Embodiments of the method may include fastening a cable remover to the telecommunications device, plugging the telecommunications cable connector plug into the telecommunications cable connector jack, and applying force to a touch point of the cable remover. Embodiments may also include rotating the cable remover about an axis of a pivot in response to the applying force, and compressing a release lever of the telecommunications cable connector plug with an arm of the cable remover in response to rotating the cable remover. Embodiments may also include disengaging the telecommunications cable connector plug from the telecommunications cable connector jack in response to the compressing and withdrawing the telecommunications cable from the telecommunications device.

BRIEF DESCRIPTION OF THE DRAWINGS

Advantages of the invention will become apparent upon reading the following detailed description and upon reference to the accompanying drawings in which like references may indicate similar elements.

DETAILED DESCRIPTION OF EMBODIMENTS

Figure 1:
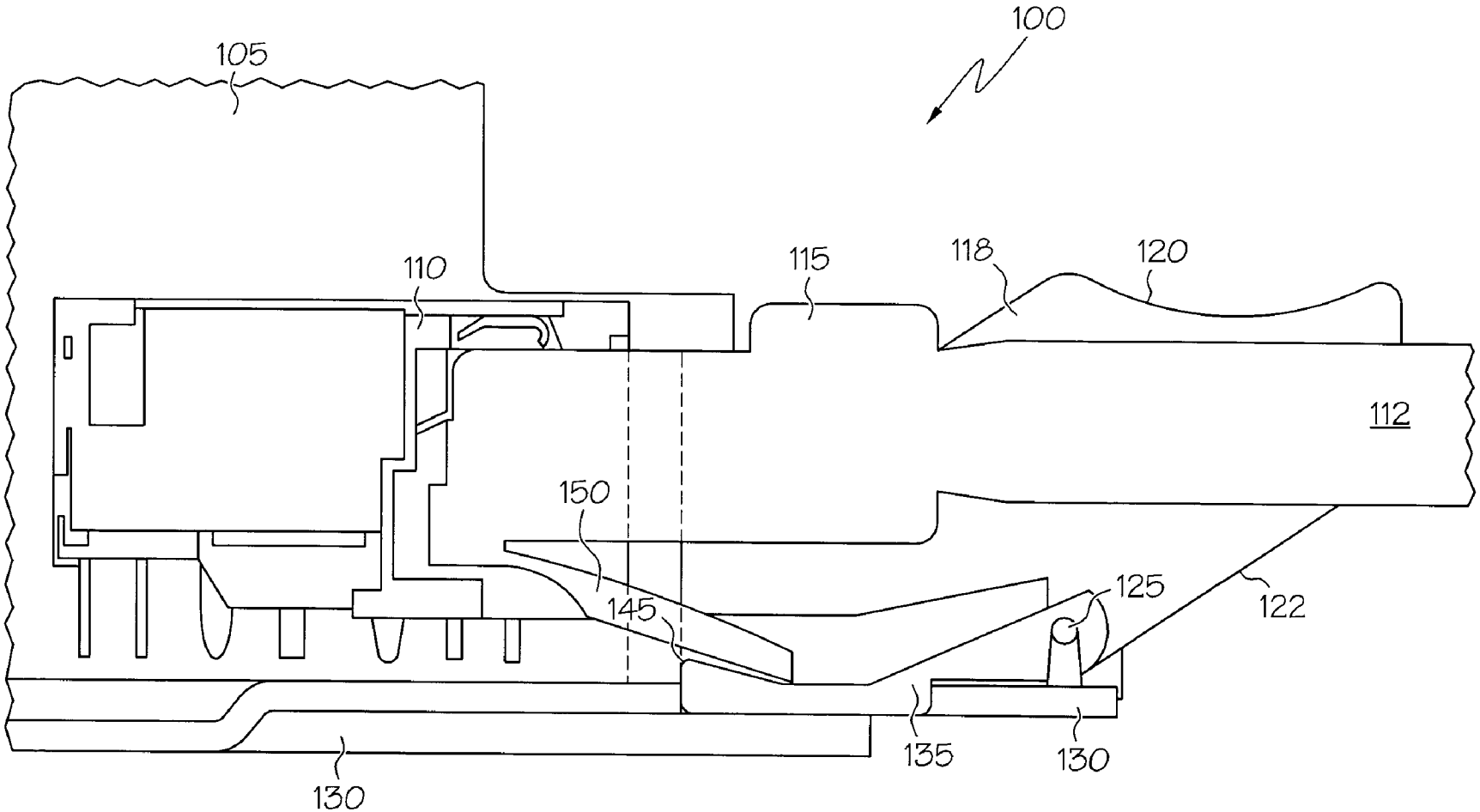
FIG. 1 depicts a side view of an embodiment of a system to release a telecommunications cable connector plug from a telecommunications cable connector jack of a telecommunications device, with the plug connected.

The following is a detailed description of embodiments of the invention depicted in the accompanying drawings. The embodiments are in such detail as to clearly communicate the invention. However, the amount of detail offered is not intended to limit the anticipated variations of embodiments; but on the contrary, the intention is to cover all modifications, equivalents, and alternatives falling within the spirit and scope of the present invention as defined by the appended claims. The detailed descriptions below are designed to make such embodiments obvious to a person of ordinary skill in the art.

Generally speaking, systems, methods, and apparatus to release a telecommunications cable connector plug from a telecommunications cable connector jack of a telecommunications device are disclosed. Embodiments may include an apparatus to release a telecommunications cable connector plug from a telecommunications cable connector jack of a telecommunications device. The apparatus may include a pivot and a main body attached to the pivot to rotate about a longitudinal axis of the pivot. The main body may include an arm and a touch point. When the main body is suitably positioned by the attaching of the apparatus to the telecommunications device, a force applied at the touch point may produce a rotation of the arm. The rotation may cause the leading surface of the arm to compress a release lever of the telecommunications cable connector plug and to disengage the telecommunications cable connector plug from the telecommunications cable connector jack.

In some embodiments, the apparatus may be composed of plastic or other dielectric material. In many embodiments, the pivot may consist of a wire passing through a hole in the main body. In other embodiments, the pivot may consist of two posts, the two posts extending from opposing lateral surfaces of the main body along the longitudinal axis of the pivot. Each post may be configured to fit into the hole of connector to the telecommunications device. In some embodiments, the apparatus may be adapted to release RJ-45 plugs from RJ-45 jacks.

The disclosed apparatus may provide for an effective mechanism for releasing a telecommunications cable connector plug from a telecommunications cable connector jack of a telecommunications device. Using the disclosed apparatus, a user may depress the touch point to release a telecommunications cable connector plug. In response to the pressure on the touch point, the main body may rotate around the pivot axis, causing the leading surface of the arm to compress the release lever of the telecommunications cable connector plug. As the rotation continues, the compression may cause the release of the plug from the jack. The plug may then be removed from the jack by pulling on the cable. A user of the disclosed apparatus may thus efficiently and effectively remove a telecommunications cable connector plug from a telecommunications cable connector jack of a telecommunications device. Using the apparatus may be particularly useful when the plug is in a difficult-to-reach location or the release lever is difficult to see. The use of the apparatus may move the point at which a user presses to release the plug away from a crowded area around the telecommunications devices to an area with easier access.

While specific embodiments will be described below with reference to particular circuit or logic configurations, those of skill in the art will realize that embodiments of the present invention may advantageously be implemented with other substantially equivalent configurations.

FIG. 1 depicts a side view of an embodiment of a system 100 to release a telecommunications cable connector plug from a telecommunications cable connector jack of a telecommunications device. System 100 includes a computer 105, a telecommunications cable 112, and a cable remover 118. Computer 105 may be one of many computers spaced very closely together, such as 1U servers or blade servers arrayed in a server rack. For example, computer 105 may be one of seven 1U servers placed in a 7U server rack. A 1U server is less than 2 inches tall. Computer 105 includes RJ-45 jack 110 and chassis 130.

Cable 112 may provide a communications connection such as a network connection to computer 105. Computer 105 may be connected to the Internet or another network by telecommunications cable 112. The telecommunications cable 112 may, for example, provide an Ethernet connection. Cable 112 may end in RJ-45 plug 115 which connects to RJ-45 jack 110 in computer 105. RJ-45 plug 115 includes RJ-45 release latch 150. RJ-45 plug 115 and RJ-45 jack 110 may contain a number of pins or connectors which fit together when the RJ-45 plug 115 and RJ-45 jack 110 are snapped together. RJ-45 release latch 150 may be spring loaded and may snap into RJ-45 jack 110 when the RJ-45 plug 115 and RJ-45 jack 110 are pushed together. RJ-45 release latch 150 may have a front end anchored to a front underside portion of the RJ-45 plug 115, and a free rear or outer end. When RJ-45 plug 115 is inserted into RJ-45 jack 110, the free outer end of release latch 150 may be upwardly bent. A tab on RJ-45 plug 115 may releasably latch RJ-45 plug 115 within RJ-45 jack 110. By pushing the rear end of RJ-45 release latch 150 upwardly, RJ-45 plug 115 may be unlatched and may be pulled rearwardly out of RJ-45 jack 110.

Cable remover 118 includes main body 122 and pivot 125. Cable remover 118 may be composed of plastics, metals such as die-cast aluminum, ceramics, other suitable firm materials, or a combination of these materials. In some embodiments, the materials may constitute dielectric or electrically insulating or non-conductive material. Dielectric materials may include polymeric or plastic materials such as polycarbonate (PC), ABS and/or PC/ABS blend. The use of a non-conductive material such as plastic or ceramic may minimize the chance of an electrical short in the event that the computer 105 is not properly protected.

Main body 122 includes touch point 120 and arm 135. Arm 135 includes front edge of arm 145. Touch point 120 may be shaped to conform to a fingertip to enable greater control. A user may press RJ-45 cable remover 118 at touch point 120 to rotate the main body 122, including arm 135, around the axis of pivot 125. As arm 135 rotates, front edge of arm 145 may press against RJ-45 release latch 150 and compress RJ-45 release latch 150. The compression may disengage RJ-45 plug 115 from RJ-45 jack 110. Cable 112 may then be pulled to disconnect cable 112 from computer 105.

Cable remover 118 may facilitate releasing RJ-45 plug 115 from RJ-45 jack 110. Access to a touch point at RJ-45 release latch 150 to manually depress RJ-45 release latch 150 may prove difficult because of lack of space. The use of cable remover 118 moves the point at which to press to disconnect cable 112 (touch point) from RJ-45 release latch 150 outward from computer 105 to touch point 120. The touch point farther away from the computer 105 may be easier to access and easier to see.

Cable remover 118 may be designed to release a single cable. Pressing cable remover 118 at touch point 120 may cause the compression of a single release latch, and thereby release a single cable. Removing a single cable may prove useful. There may be a problem with the cable, or a need to test computer 105 with a single connection removed.

The system 100 is for explanation, not for limitation. Cable removers may operate to remove telecommunications cable plugs other than RJ-45 plugs. In some embodiments, cable removers may remove modular plugs from the corresponding jacks. The plug and terminated cable may be used in high speed data transmission lines; for example, of the type including shielded twisted wire pairs and foil twisted pair cable plugs. The plug may be other types of RJ-plugs, including RJ-11 plugs, RJ-12 connectors, RJ-25 plugs, and RJ-22 plugs. The plug may comply with the standards of at least one of the following: the International Electrotechnical Commission (IEC), the Telecommunications Industry Association (TIA), and the Electronic Industries Alliance (EIA). A suitable plug may include telephone cable plugs, LC (Lucent Connector or Local Connector) fiber optical connectors, E2000 fiber optical connectors, or other telecommunications cable plugs with a release latch as will occur to those of skill in the state of the art. Cable removers may operate with other kinds of telecommunications devices than computers, including networking equipment such as routers and bridges and telephone equipment. In some embodiments of a cable remover, the touch point may be configured differently. For example, the touch point may simply be flat. In a few embodiments, a cable remover may lack a spring.

Figure 2:
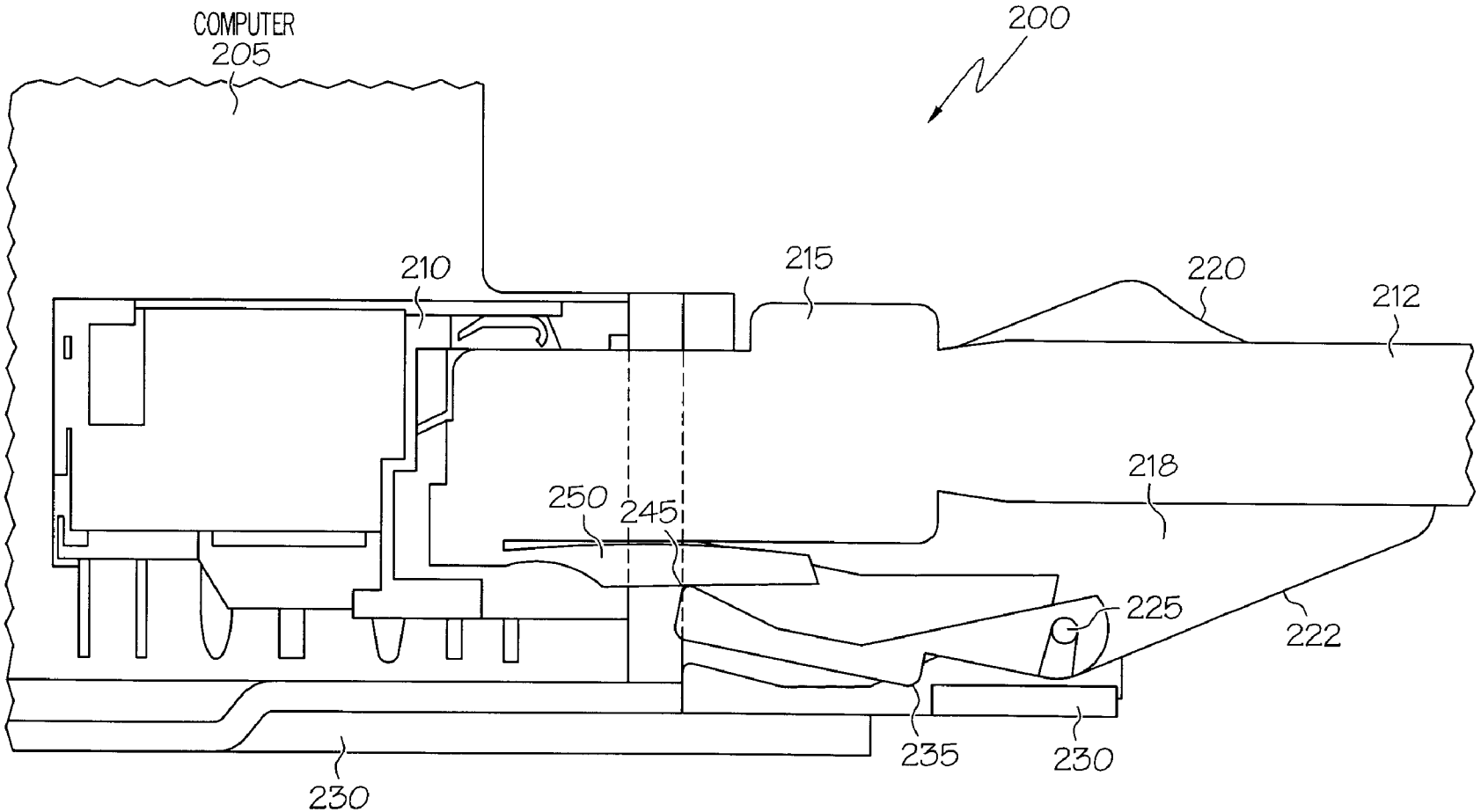
FIG. 2 depicts a side view of an embodiment of a system to release a telecommunications cable connector plug from a telecommunications cable connector jack of a telecommunications device, with the plug disengaged.

Turning to FIG. 2, depicted is a side view of an embodiment of a system 200 to release a telecommunications cable connector plug from a telecommunications cable connector jack of a telecommunications device. System 200 is similar to system 100 of FIG. 1. System 200 includes a computer 205, a telecommunications cable 212, and a cable remover 218. Computer 205 includes chassis 230 and RJ-45 jack 210. Computer 205 may be connected to the Internet or another network by cable 212. Cable 212 may terminate in RJ-45 plug 215 which connects to RJ-45 jack 210. RJ-45 plug 215 includes RJ-45 release latch 250.

Cable remover 218 includes main body 222 and pivot 225. Main body 222 includes touch point 220 and arm 235. Arm 235 includes front edge of arm 245. In the diagram of FIG. 2, the main body 222 and arm 235 have rotated sufficiently to compress RJ-45 release latch 250 to a release position. Cable 212 may be removed by pulling it away from computer 205 and RJ-45 jack 210.

Figure 3:
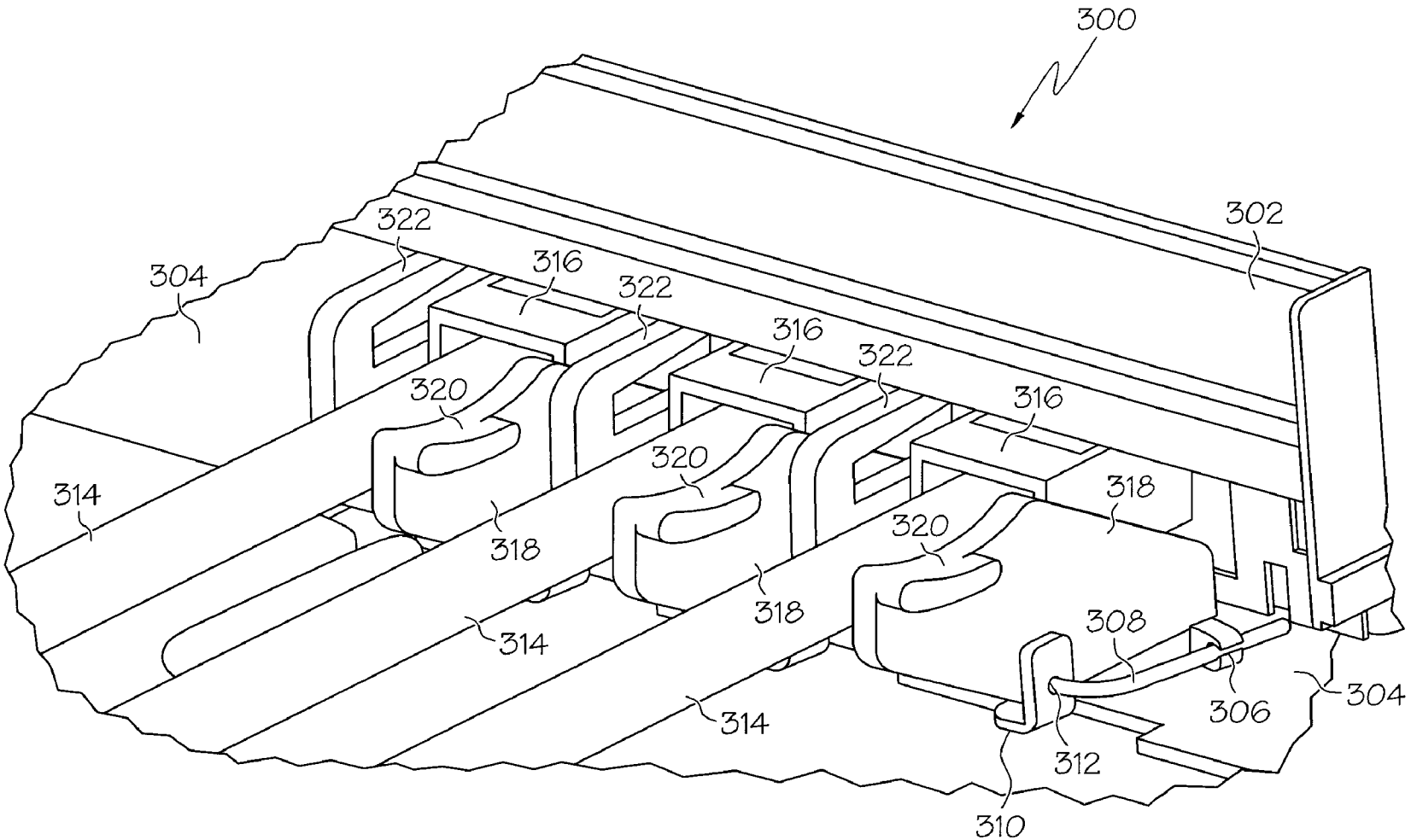
FIG. 3 depicts a rear view of an embodiment of a system to release telecommunications cable connector plugs from telecommunications cable connector jacks of a telecommunications device which includes three jacks.

FIG. 3 depicts a rear view of an embodiment of a system 300 to release telecommunications cable connector plugs from telecommunications cable connector jacks of a telecommunications device. System 300 includes a computer 302, pivot wire 308, telecommunications cables 314, and cable removers 318.

Computer 302 includes chassis extension 304, slot 306, and tab 310. Chassis extension 304 may provide a platform to hold cable removers steady in relation to computer 302. In some embodiments, chassis extensions 304 may consist of a thin metal plate that extends past the rear of computer 302. Slot 306 and tab 310 are fastened to chassis extension 304. Tab 310 includes tab hole 312. Slot 306 and tab 310 may be designed to fasten a cable remover to a chassis extension. In the embodiments of FIG. 3, slot 306 and tab 310 are designed to fasten pivot wire 308. Pivot wire 308 may pass through a hole in each cable remover 318, pass through tab hole 312 of tab 310, and bend at a right angle to the rear of computer 302, fastening in slot 306. Pivot wire 308 may end at the rear of computer 302, a short distance past slot 306. Tab hole 312 and slot 306 may be designed to hold pivot wire 308 snugly. In the diagram of FIG. 3, only one tab 310 is visible. In many embodiments, multiple tabs may be used to fasten one or more cable removers to a computer. See tabs 705 and 710 and tab holes 720 of FIG. 5.

Returning to FIG. 3, telecommunications cables 314 may provide telecommunications connections for computer 302. In some embodiments, the telecommunications cables 314 may provide a networking connection for computer 302. In other embodiments, the telecommunications cables 314 may provide a telephone connection to computer 302. The telecommunications cables 314 may consist of copper wire cable, fiber optics cable, or other types of cable that may be known to those of skill in the art.

Each telecommunications cable 314 may end in a plug 316 which connects to a jack in computer 302. The plug may include a hook or release lever. The release lever may be spring loaded and snap into the jack when the plug 316 is pushed into the jack. To release the plug 316, the release lever may be compressed. After the plug 316 is released from the jack, the cable 314 may be pulled to remove it from the jack.

A cable remover 318 includes a touch point 320 and spring 322. Pivot wire 308 passes through a hole of each cable remover 318. See hole 418 of FIG. 4. A cable remover 318 may enable the releasing of a telecommunications cable from a telecommunications device. Pressing on the touch point 320 of a cable remover 318 may cause the rotation of the cable remover 318 around the pivot point of cable remover 318, where pivot wire 308 passes through cable remover 318. The rotation may cause the leading surface of an arm of cable remover 318 to compress the hook or release latch of a plug of a cable 314, thereby releasing the plug from a jack of computer 302. The cable 314 may then be withdrawn. In the embodiment of FIG. 3, the touch point 320 is concave and broader than the nearby portions of cable remover 318.

In the embodiment of FIG. 3, spring 322 lies on the opposite side of a cable 314 from touch point 320. Cable remover 318 surrounds a cable 314. The sides of cable remover 318 may hold a cable 314 in place. Spring 322 may restore cable remover 318 to an inactive position in its rotation around pivot wire 308 when pressure is removed from touch point 320. An inactive position is a position in which an arm of cable remover 318 is not compressing a release latch of a plug 316 inserted in a jack. The rotation of the arm may cause a resistive force in spring 322 which rotates cable remover 318 back to an inactive position when pressure is released. Spring 322 may be composed of thin plastic.

In the embodiment of FIG. 3, multiple cable removers 318 are ganged or fastened together. In the embodiment of FIG. 3, a single pivot wire 308 passes through the pivot points of the three cable removers 318 shown in the diagram. To disconnect the central cable remover 318, it may be necessary to remove the pivot wire 308 from multiple cable removers 318, pull off the central cable remover 318, and restore the pivot wire 308 through the pivot hole of the remaining cable removers 318.

In the embodiment of FIG. 3, an individual cable remover 318 operates on an individual cable 314. The cable removers 318 operate independently. The rotation of one cable remover 318 causes the arm of the cable remover 318 to compress a single release lever of a cable 314. A single cable remover 318 does not rotate into multiple cables. Nor does the rotation of one cable remover affect the other cable removers. In particular, a rotational force on one cable remover is not transmitted through the common pivot wire 308 to another cable remover.

FIG. 3 is for explanation, not for limitation. In other embodiments, a touch point may be shaped differently. A touch point may, for example, simply be flat. In some embodiments, a 1-to-1 correspondence between cables and cable removers is not required. A jack may operate without a cable remover. For example, in the diagram of FIG. 3, the middle cable remover may be omitted, leaving a gap between the cable remover on the left and the cable remover on the right, and leaving a cable not covered by a cable remover. The pivot wire 308 may pass through the gap and connect to tabs on either side. In many other embodiments, the pivot may consist of a pin. In still other embodiments, the pivot may consist of plastic posts that snap into the holes such as tab hole 312 of tabs such as tab 310.

Figure 4:
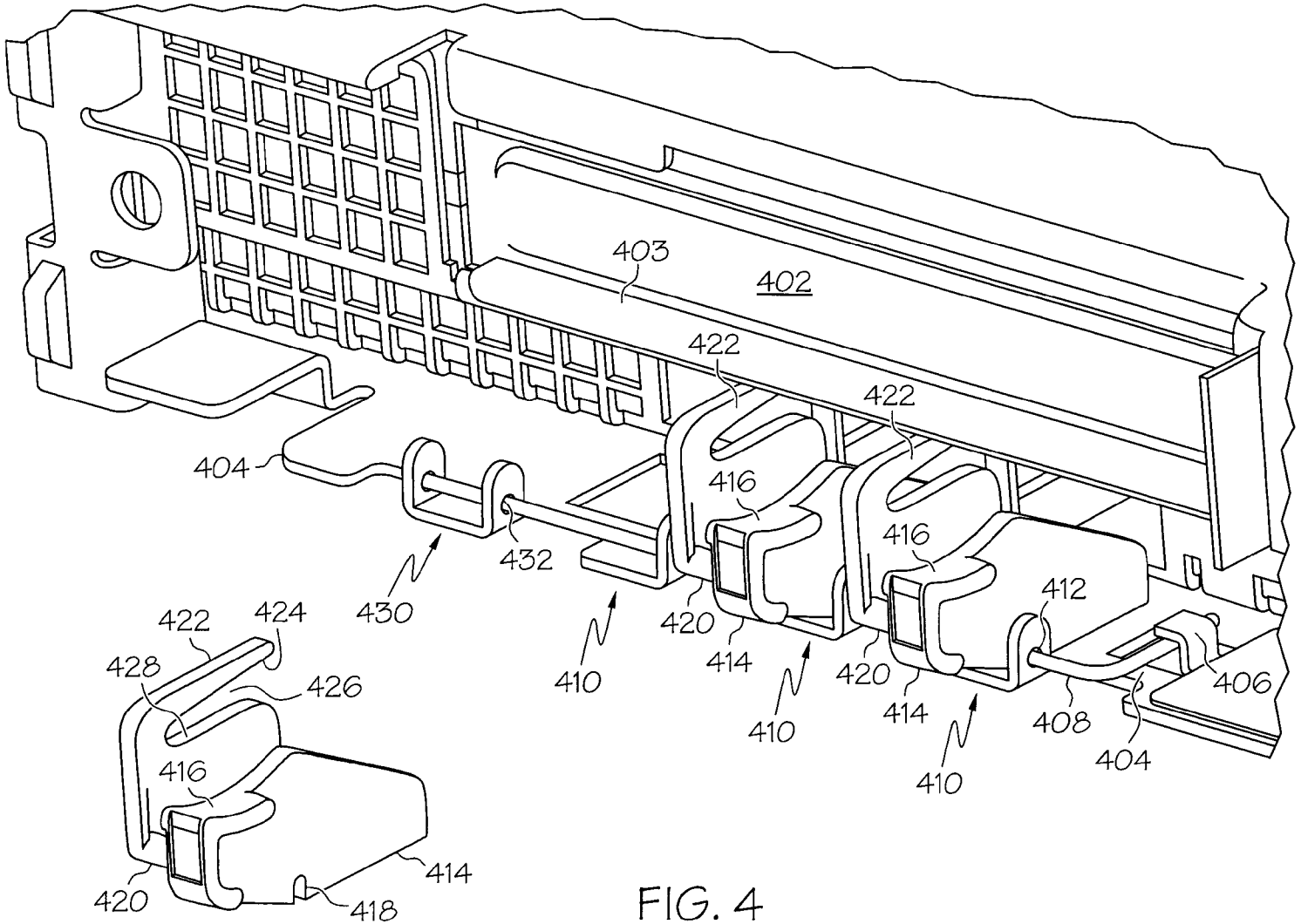
FIG. 4 depicts an additional rear view of an embodiment of a system to release telecommunications cable connector plugs from telecommunications cable connector jacks of a telecommunications device.

Turning to FIG. 4, depicted is an additional rear view of an embodiment of a system to release telecommunications cable connector plugs from telecommunications cable connector jacks of a telecommunications device. FIG. 4 includes a computer 402 and three cable removers 414. In FIG. 4, two of cable removers 414 are shown attached to computer 402 and one is shown separate from computer 402. Computer 402 includes ledge 403, chassis extension 404, slot 406, and tabs 410 and 430. Chassis extension 404 may provide a platform to hold a cable remover such as a cable remover 414 steady in relation to computer 402. Slot 406 and tabs 410 and 430 are fastened to chassis extension 404. The tabs 410 include a tab hole 412 on the right (shown only on the rightmost tab 410) and tab 430 includes tab hole 432 on the right. In the embodiment of FIG. 4, tab 432 also contains a tab hole on the left and the pivot wire 408 rests in the left hole. In other embodiments, the left side of tab 430 may be solid and pivot wire 408 may end slightly to the right of the left side of tab 430.

Figure 5:
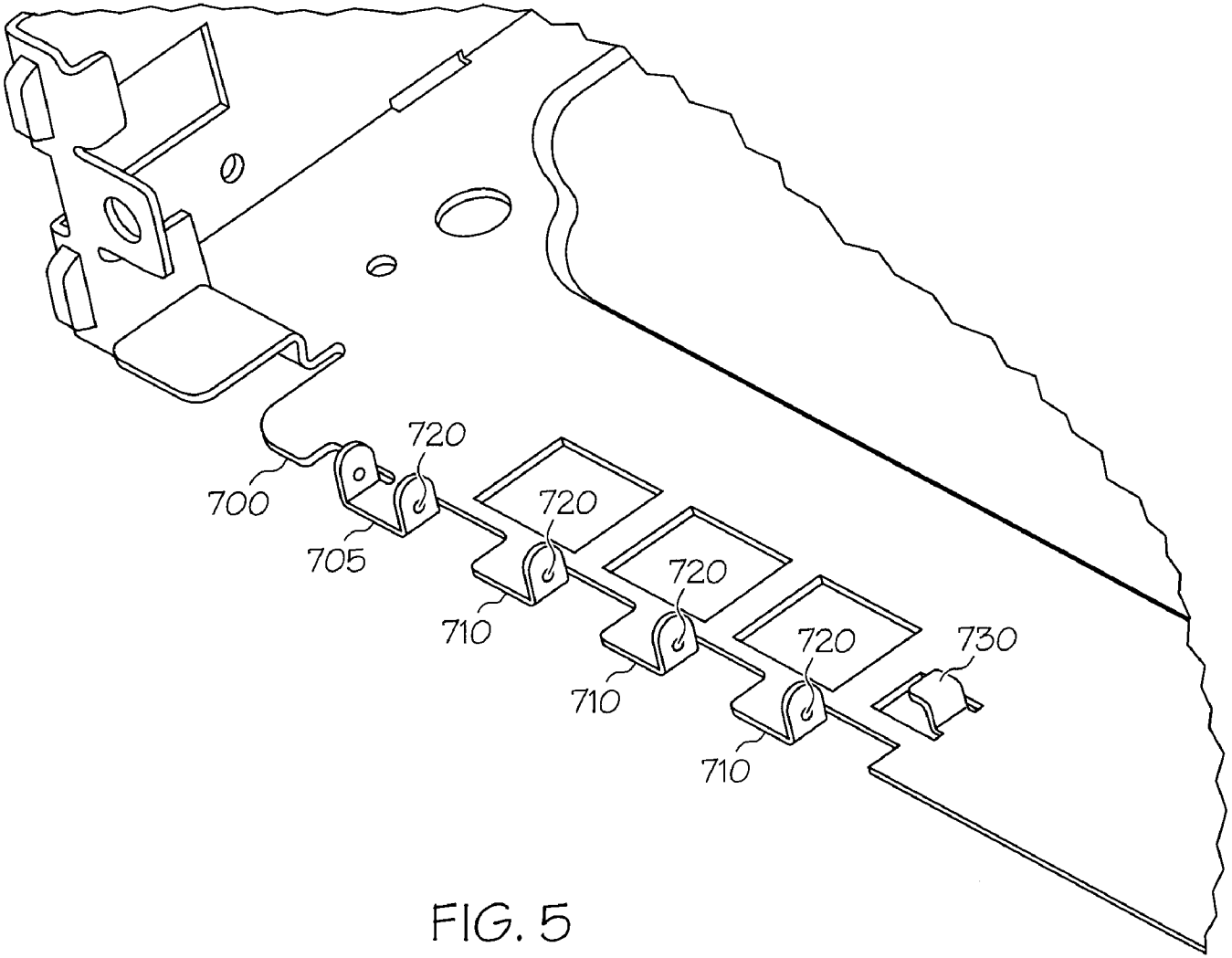
FIG. 5 depicts a diagram of an embodiment of a system to fasten cable removers to a telecommunications device.

A clear view of similar tabs is shown in FIG. 5. Chassis 700 contains tabs 705 and 710 suitable for holding cable removers. Each of the tabs 710 contains a hole 720 on its right. Up to three cable removers may be placed between the four tabs. The cable removers may be secured by a pivot, such as a pivot wire, which may pass between pivot holes of the cable removers and the holes 720 of the tabs. In the embodiment of FIG. 5, tab 705 contains holes on both the left and right side. In other embodiments, tab 705 may contain a hole only on the right side.

Returning to FIG. 4, slot 406 and tabs 410 and 430 may be designed to fasten a cable remover to a chassis extension. In the embodiments of FIG. 4, slot 406 and tabs 410 and 430 are designed to fasten pivot wire 408, the pivot of cable removers 414, to the chassis extension 404. From the left in the embodiment of FIG. 4, pivot wire 408 passes through hole 432 of tab 430, and through three tabs 410 and two cable removers 414. Each of the two cable removers 414 attached to computer 402 has a tab 410 on each side. Pivot wire 408 may pass through a hole, such as hole 418, in a cable remover 414, and pass through a tab hole 412 of a tab 410. After passing through the tab hole 412 of the rightmost tab 410, pivot wire 408 may bend at a right angle to the rear of computer 402, fastening in slot 406. Pivot wire 408 may end at the rear of computer 402, a short distance past slot 406. Tab holes 412 and 432 and slot 406 may be designed to hold pivot wire 408 snugly.

The cable removers 414 include touch points 416, bridges 420, and springs 422. In the embodiment of FIG. 4, the cable removers 414 also contain a pivot hole 418, displayed only in the cable remover separate from computer 402. A cable remover 414 may operate to disconnect a telecommunications plug from a telecommunications jack. Pressing touch point 416 of a cable remover 414 may cause the cable remover 414 to rotate around the axis of a pivot wire passing through the pivot hole. The rotation may cause an arm of the cable remover 414 to compress a release latch of a telecommunications plug, detaching it from a telecommunications jack.

Spring 422 may contain spring slot 426. Spring slot 426 may include slot upper arm 424 and slot lower surface 428. A spring 422 may restore a cable remover 414 to an inactive position in its rotation around the pivot axis when pressure is removed from a touch point 416. The rotation of cable remover 414 may cause slot upper arm 424 to press against ledge 403, generating a resistive force which rotates the cable remover 414 back to an inactive position when pressure is released. Spring 422 may be composed of thin plastic.

Bridge 420 may hold together the left and right sides of a cable remover 414. The sides may be designed to securely hold a telecommunications cable placed between them, and thereby to enable the rotation of a cable remover 414 around a pivot axis to compress the release latch of the telecommunications cable plug, rather than simply pushing the cable plug away from the cable remover 414.

The diagram of FIG. 4 is for illustration and not limitation. A cable remover may omit a spring. The touch point of a cable remover may be flat rather than contoured. The pivot may consist of posts extending from a main body rather than an element passing through a hole contained in the main body.

Figure 6A:
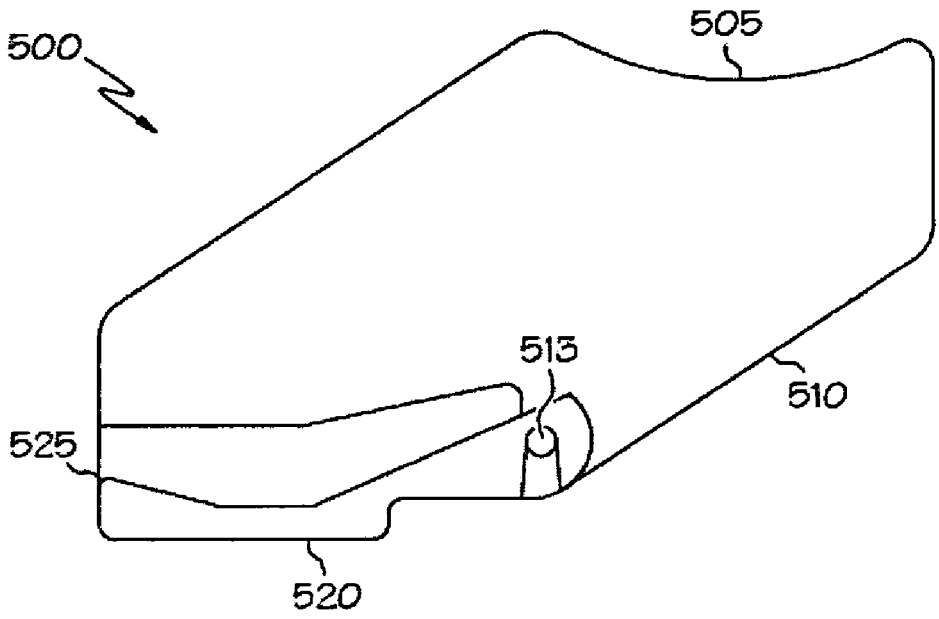
FIG. 6A depicts a side view of an embodiment of an apparatus to release a telecommunications cable connector plug from a telecommunications cable connector jack of a telecommunications device.

FIG. 6A depicts a side view of a cable remover 500 to release a telecommunications cable connector plug from a telecommunications cable connector jack of a telecommunications device. Cable remover 500 includes main body 510 Main body includes touch point 505, rotating arm 520, and pivot hole 513. A pivot may pass through pivot hole 513. Rotating arm 520 includes leading edge 525.

Figure 6B:
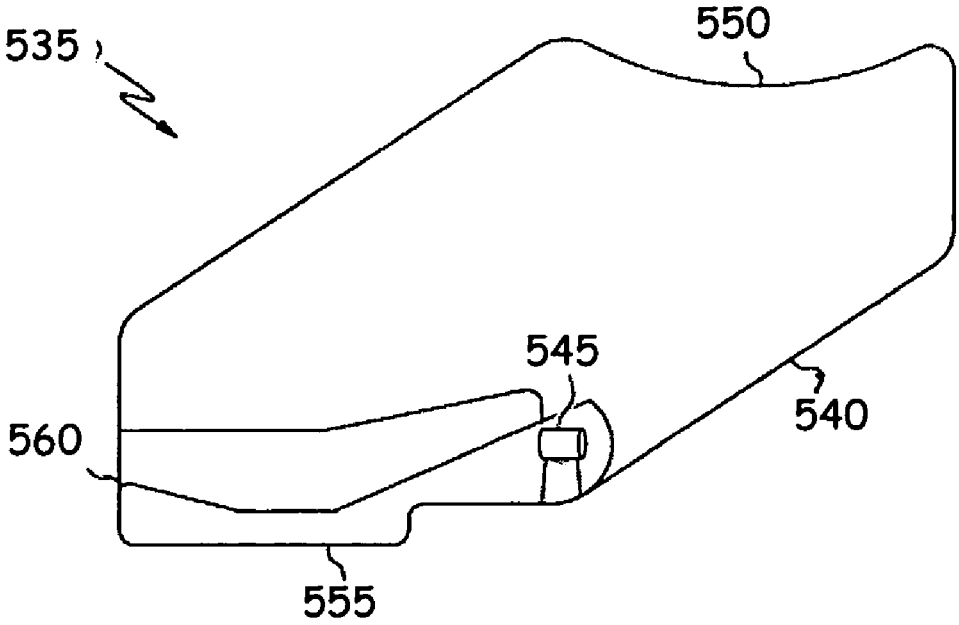
FIG. 6B depicts an addition side view of an embodiment of an apparatus to release a telecommunications cable connector plug from a telecommunications cable connector jack of a telecommunications device.

FIG. 6B depicts another side view of a cable remover 535 to release a telecommunications cable connector plug from a telecommunications cable connector jack of a telecommunications device. Cable remover 535 is similar to cable remover 500 of FIG. 6A, except that it pivots on posts instead of on a pivot inserted through pivot holes. Cable remover 535 includes main body 540 and post 545. Main body 540 includes touch point 550 and rotating arm 555. In some embodiments, post 545 and a corresponding post located on the other side of main body 540 may be inserted through holes of brackets to enable main body 540 to pivot along an axis between the two posts. As main body 540 pivots, leading edge 560 of rotating arm 555 may compress a release lever of a telecommunications cable connector.

Cable remover 500 may operate to disconnect a telecommunications plug from a telecommunications jack. Pressing touch point 505 may cause cable remover 500 to rotate around the axis of a pivot passing through pivot hole 513. The rotation may cause leading edge 525 of rotating arm 520 to compress a release latch of a telecommunications plug, releasing it from a telecommunications jack.

The diagrams of FIG. 6A and FIG. 6B are for illustration and not limitation. In other embodiments of cable removers, the elements may be configured as will occur to those of skill in the state of the art. In many embodiments, the touch point of a cable remover may be flat rather than contoured.

Figure 7:
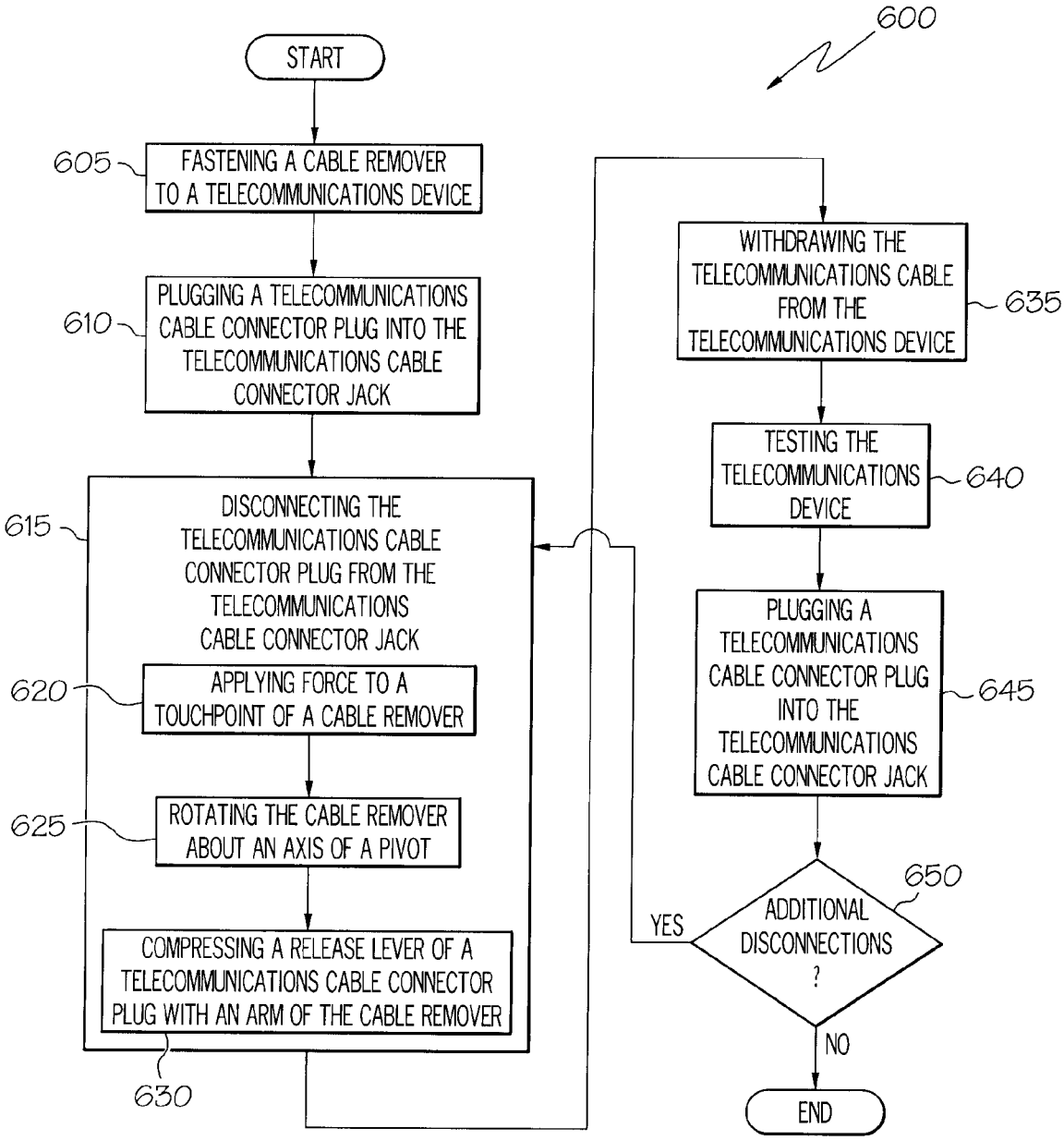
FIG. 7 depicts a flow chart of an embodiment of a method to release a telecommunications cable connector plug from a telecommunications cable connector jack of a telecommunications device.

Turning to FIG. 7, depicted is a flowchart 600 of an embodiment to release a telecommunications cable connector plug from a telecommunications cable connector jack of a telecommunications device. Flowchart 600 begins with fastening a cable remover to a telecommunications device (element 605). In some embodiments, a pivot wire passing through a pivot hole in the main body of the cable remover may fasten to tabs and slots of the telecommunications device. In other embodiments, the cable remover may lie upon a platform which is fastened to the telecommunications device. The telecommunications device may be extended with a platform to which the cable remover is fastened.

The method of flowchart 600 includes plugging a telecommunications cable connector plug into a telecommunications cable connector jack of the telecommunications device (element 610). Pushing the plug into the jack may cause a release lever to snap into place, securing the plug to the jack and providing a telecommunications connection to the telecommunications device. The method includes disconnecting the telecommunications cable connector plug from the telecommunications cable connector jack (element 615). The disconnecting may include applying force to a touch point of a cable remover (element 620). Applying the force may cause the rotation of the cable remover about an axis of a pivot (element 625). As the cable remover rotates, an arm of the cable remover may compress a release lever of a telecommunications cable connector plug (element 630). The compression may release the plug from the jack.

The method of flowchart 600 also includes withdrawing the telecommunications cable from the telecommunications device (element 635). Once the plug has been released from the jack, the cable may be pulled away from the telecommunications device. The telecommunications device may be tested after the cable has been withdrawn (element 640). The method of flowchart 600 also includes plugging a telecommunications cable connector plug into a telecommunications cable connector jack (element 645) of the telecommunications device. In some embodiments, once the testing has been completed, the connection may be restored. If there are additional cables to be disconnected, elements 615 through 645 may be repeated. If there are no additional cables to be disconnected, the method of flowchart 600 may end.

The elements of flowchart 600 are for illustration and not for limitation. In alternative embodiments, some of the elements of flowchart 600 may be omitted or other elements may be added. For example, in some embodiments, after removal of a cable, there may be no testing. The cable may be immediately replaced. Similarly, a connection may be removed permanently and not replaced with another connection.

It will be apparent to those skilled in the art having the benefit of this disclosure that the present invention contemplates a system, method, and apparatus to release telecommunications cable connector plugs from telecommunications cable connector jacks of telecommunications devices. It is understood that the forms of the invention shown and described in the detailed description and the drawings are to be taken merely as examples. It is intended that the following claims be interpreted broadly to embrace all the variations of the example embodiments disclosed.

While certain operations have been described herein relative to a direction such as "above" or "below" or "left" or "right" it will be understood that the descriptors are relative and that they may be reversed or otherwise changed if the relevant structure(s) were inverted or moved. Therefore, these terms are not intended to be limiting.

Although the present invention and some of its advantages have been described in detail for some embodiments, it should be understood that various changes, substitutions and alterations can be made herein without departing from the spirit and scope of the invention as defined by the appended claims. Although an embodiment of the invention may achieve multiple objectives, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus to release a connector plug of a telecommunications cable from a telecommunications cable connector jack of a telecommunications device, the apparatus comprising:

a pivot comprising a wire; and a main body attached to the pivot, the main body comprising:

a rotation arm having a top surface portion and a through pivot hole at one end of the rotation arm, the pivot hole being substantially at the middle of the body; and a touch point, the rotation arm located apart from the touch point, wherein:

the apparatus is to be attached to the telecommunications device; and the entire main body is to rotate as a unit about a longitudinal axis of the pivot upon the application of sufficient force at the touch point, the rotation comprising a rotation of the rotation arm, the rotation of the rotation arm causing a leading surface of the rotation arm to compress a release lever of the telecommunications cable connector plug and to disengage the telecommunications cable connector plug from the telecommunications cable connector jack;

the pivot is to intersect only the main body in a plane perpendicular to the longitudinal axis of the pivot;

the hole is to lie along the longitudinal axis of the pivot; and the wire is to pass through the hole.

2. The apparatus of claim 1, further comprising another main body containing a hole, wherein the wire passes through the hole of the other main body and the other main body is adapted to rotate along the axis of the wire.

3. The apparatus of claim 1, wherein the main body is comprised of one or more of metal, plastic, die-cast aluminum, or ceramic.

4. The apparatus of claim 1, wherein the touch point is adapted to conform to a fingertip.

5. The apparatus of claim 1, wherein the apparatus is adapted to release RJ-45 plugs from RJ-45 jacks.

* * * * *